US006293072B1

(12) United States Patent
Hodgson

(10) Patent No.: US 6,293,072 B1
(45) Date of Patent: Sep. 25, 2001

(54) BUILDING COMPONENTS

(76) Inventor: Mark R. Hodgson, 23632 Highway 99 #406, Edmonds, WA (US) 98026

( * ) Notice: Subject to any disclaimer, the term of this patent is extended or adjusted under 35 U.S.C. 154(b) by 0 days.

(21) Appl. No.: 09/344,417

(22) Filed: Jun. 26, 1999

(51) Int. Cl.[7] ..... E04C 2/38
(52) U.S. Cl. ..... 52/716.1
(58) Field of Search ..... 52/58, 97, 96, 52/211, 204–53, 717.01, 478, 436, 208, 213, 404, 474, 475.1, 716.01

(56) References Cited

U.S. PATENT DOCUMENTS 2,309,453 * 1/1943 Hasenburger et al. .
2,727,283 * 12/1955 Gollner .
3,261,136 * 7/1966 Abner et al. .
3,771,271 * 11/1973 Keel .
4,843,783 * 7/1989 Taravella ..... 52/98
5,022,204 * 6/1991 Anderson ..... 52/211
5,265,388 * 11/1993 Sherwood ..... 52/213
5,586,415 * 12/1996 Fisher et al. ..... 52/58
6,122,877 * 9/2000 Hendrickson et al. ..... 52/520

* cited by examiner

*Primary Examiner*—Daniel P. Stodola
*Assistant Examiner*—Curtis A. Cohen
(74) *Attorney, Agent, or Firm*—Miller Nash LLP

(57) ABSTRACT

Trim bands for buildings having at least one trim element and one or more spacer elements which may be separate from or integral parts of the trim bands. The trim bands can be fabricated from a variety of materials including, but not limited to, wood, polymers, concrete, and other composites. The trim bands can be used to trim off siding, to dress a window or door, or as a corner treatment.

24 Claims, 4 Drawing Sheets

BUILDING COMPONENTS

TECHNICAL FIELD OF THE INVENTION

The present invention relates to buildings with novel, improved trim components.

BACKGROUND OF THE INVENTION

Many houses (and other buildings) have exteriors faced with lap siding which is topped with a trim band. In conventional constructions of this character moisture is apt to penetrate between the trim band and the exterior wall sheathing (or sub siding) and migrate downwardly between the sheathing and the siding. This trapped moisture can lead to rotting of the trim bands and the siding and, perhaps, other building components.

Trim bands as heretofore constructed also tend to be expensive, both in terms of material cost and in the labor required to install them.

SUMMARY OF THE INVENTION

There have now been invented and disclosed herein certain new and novel trim bands which do not have the defects of and are otherwise superior to conventional trim bands.

The novel trim bands of the present invention may be fabricated from wood, concrete and other composites, polymers, and perhaps other materials. They are significantly superior to conventional trim bands, which are made of dimension (2×) boards because they use much less material. The novel trim bands disclosed herein are also, by virtue of their novel construction, lighter and thereby easier and less expensive to install.

Furthermore, the cleats or spacer elements of the trim bands disclosed herein space the facing components of the trim bands from the substructures to which the trim bands are attached. This arrangement, in combination with appropriate flashing, helps to keep moisture from collecting behind the trim bands and rotting out that component and/or the substrate to which the trim band is fastened.

Yet another important advantage of the trim bands disclosed herein is that their construction involves principles which can equally well be employed in the fabrication of door, window, corner, and other trim components including the fabrication of both horizontal and vertical trim bands.

The objects, features, and advantages of the present invention will be apparent to the reader from the foregoing, the appended claims, and the ensuing detailed description and discussion of the invention taken in conjunction with the accompanying drawing.

DETAILED DESCRIPTION OF THE INVENTION

Figure 1:
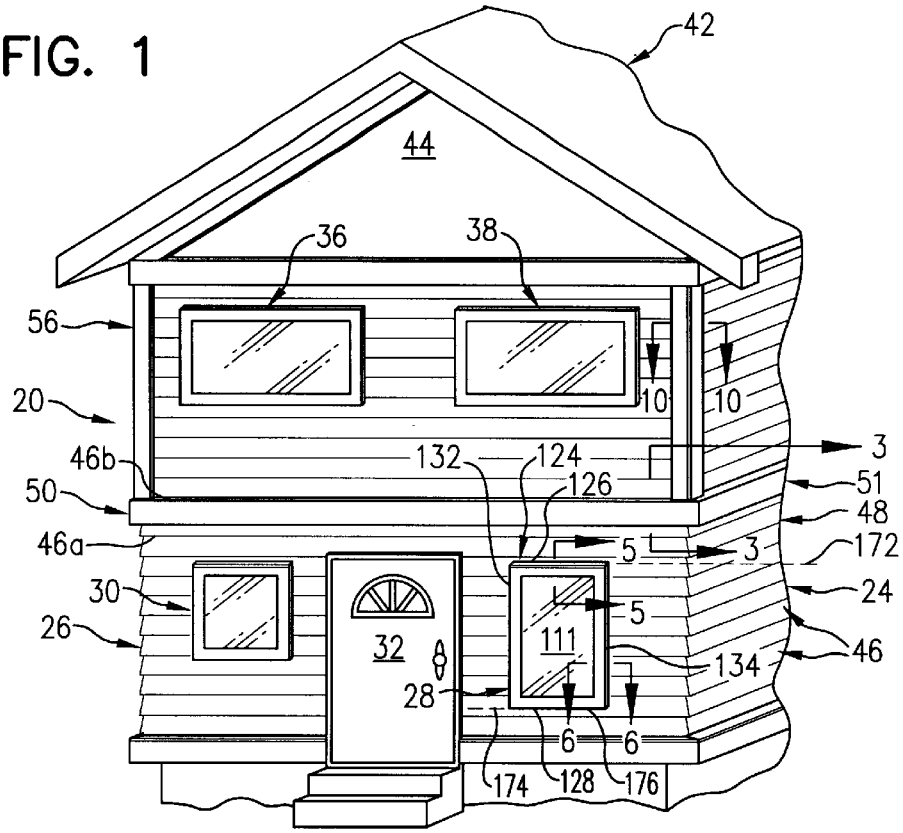
FIG. 1 is a pictorial view of a house with a trim band and exterior siding; the trim band is fabricated in accord with the principles of the present invention.

Referring now to the drawings, FIG. 1 depicts a building 20—in this case, a single family dwelling.

Building 20 has a side wall 24, a front wall 26, and a second side wall and rear wall (not shown). First story windows 28 and 30, a door 32, and second story windows 36 and 38 are formed in the front wall 26 of building 20.

Building 20 is topped with a conventional gable roof 42, there being a gable end 44 at the front 26 of building 20 and a corresponding gable end (not shown) at the rear of the building.

The external sides of the building's walls are covered with conventional lap siding 46. At a level corresponding to the top of the building's first story 48 are front wall and side wall trim bands 50 and 51. The front and side wall trim bands are of like construction. Accordingly, only trim band 50 will be described in detail.

Figure 2:
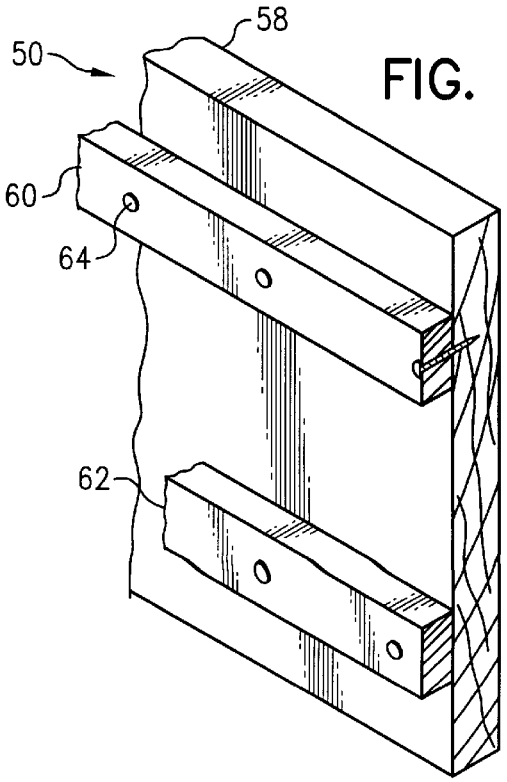
FIG. 2 is a perspective view of the FIG. 1 trim band.
Figure 3:
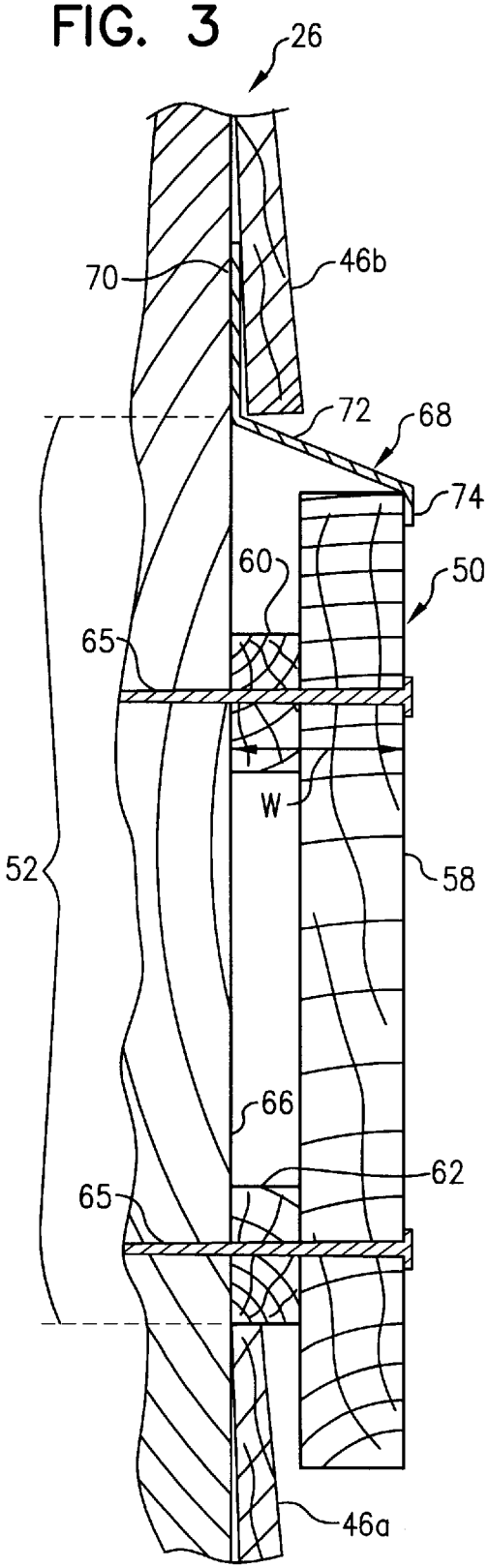
FIG. 3 is a section through the trim band and siding of the FIG. 1 house taken along line 3—3 of FIG. 1.

Referring now to FIGS. 2 and 3 as well as FIG. 1, trim band 50 spans a gap 52 between two siding members 46*a* and 46*b* located generally at the top of the building's first floor 48 and the bottom of second story 56. The trim band is made up of a trim element 58 and spacers 60 and 62 fastened as by nails 64 to trim band element 58. Trim element 58 overlaps siding members 46*a* and 46*b* (sec. FIGS. 1 and 3).

Trim band 50 is secured as by nails 65 to sub siding 66.

Moisture is kept from the space 53 between trim band element 58 and sub siding 66 by flashing 68. This building component has an upper element 70 trapped between lap siding element 46*b* and sub siding 66, a second, integral element 72 pitched downwardly and extending from element 70 to the exterior of trim element 58, and a third, also integral lower element 74 extending downwardly over trim element 58.

As is apparent from FIGS. 2 and 3, trim band 50 uses substantially less material then a conventional trim band of the same thickness W (see FIG. 3). At the same time, trim band 50 is easier to install and therefore less labor intensive than a conventional trim band.

Figure 7:
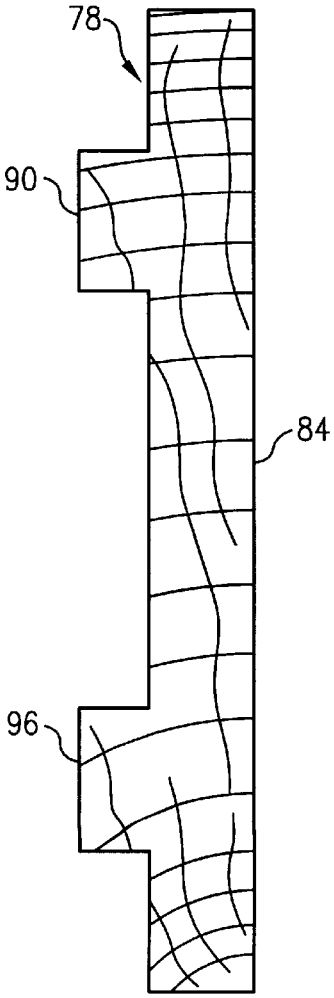
FIGS. 7–9 are sections through three alternate trim bands also embodying the principles of the present invention.
Figure 8:
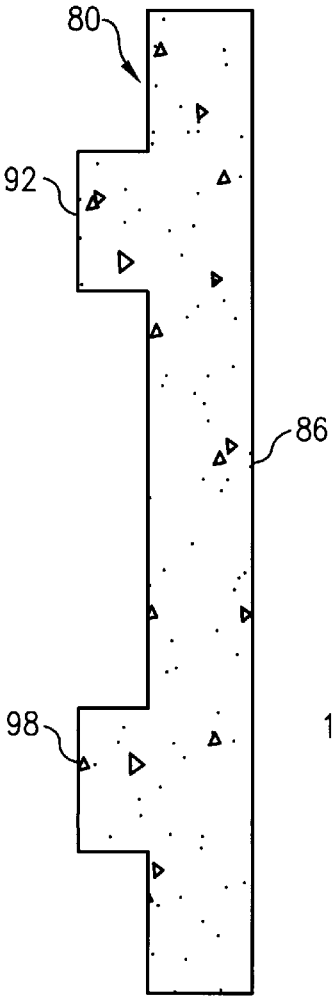
Figure 9:
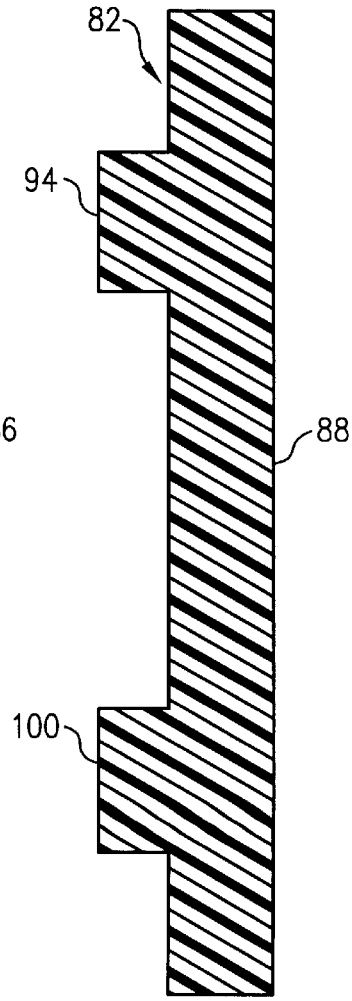

Trim bands embodying the principles of the present invention do not have to be fabricated of multiple members as is trim band 50. Instead, they can, if desired, be components with integral trim and spacer elements. Thus, FIGS. 7, 8, and 9 respectively show one-piece trim bands 78, 80, and 82 respectively fabricated from wood, a composite material, and a vinyl or other polymer. Each of the trim bands 78, 80, and 82 has a trim element and integral, vertically separated spacer elements. The trim elements are respectively identified by reference characters 84, 86, and 88; the upper spacer elements by reference characters 90 (FIG.7), 92 (FIG.8), and 94 (FIG.9); and the lower spacer elements by reference characters 96, 98, and 100.

Figure 4:
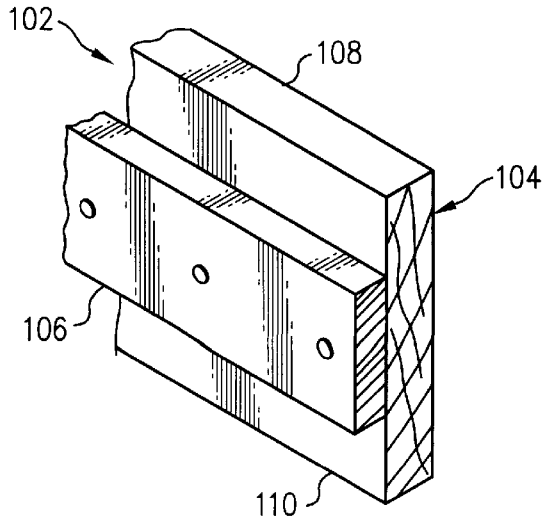
FIG. 4 is a perspective view of a window treatment for the FIG. 1 house; the components are constructed and assembled in accord with the principles of the invention.

Still another trim band embodying the principles of the present invention is illustrated in FIG. 4 and identified by reference character 102. Like the trim band 50 depicted in FIG. 2, the component 102 shown in FIG. 4 has a trim element (in this case identified by reference character 104) but only a single spacer 106. This spacer is assembled to trim element 104 midway between the lower and upper edges 108 and 110 of the trim element.

Figure 5:
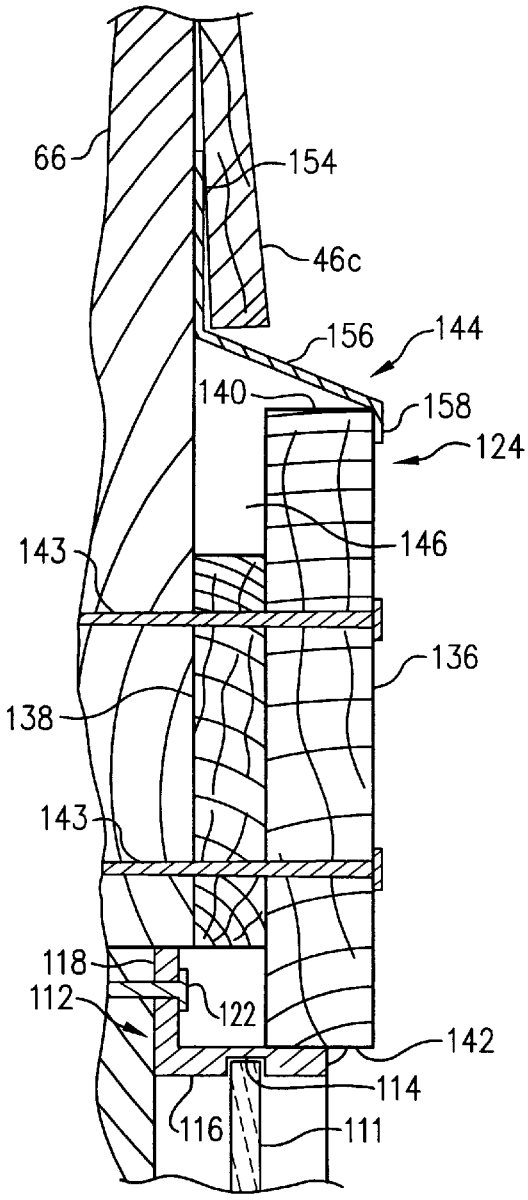
FIG. 5 is a section through a representative window of the FIG. 1 house taken along line 5—5 of FIG. 1.
Figure 6:
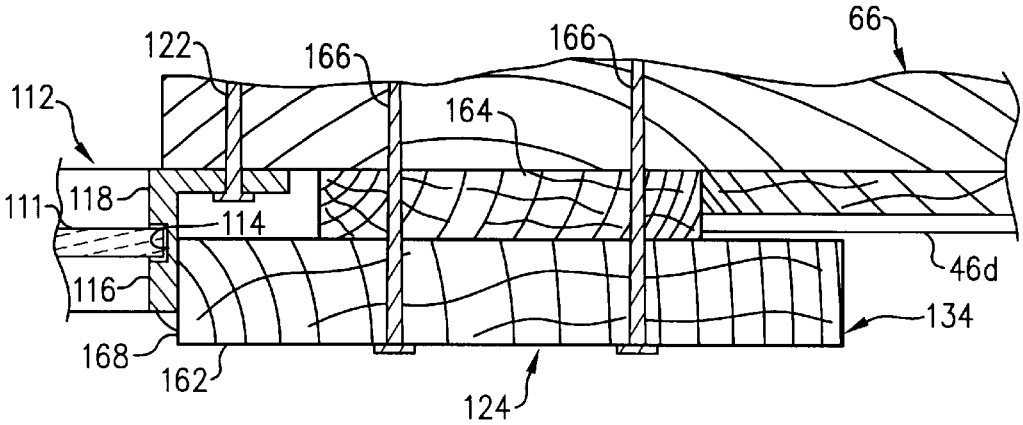
FIG. 6 is a section through the window taken along line 6—6 of FIG. 1.

Referring now to FIGS. 1, 5, and 6, the principles of the present invention may be applied to window treatments as well as to trim bands. Thus, FIG. 5 shows how the horizontal aspect of a window is treated, and FIG. 6 shows a treatment for the vertical aspect of the window.

Specifically, FIG. 5 shows a fragment of window 28 which includes a pane 111 and an angle-type support 112 for the pane. Pane 111 is seated in a recess 114 formed in an outwardly extending leg 116 of the support. A second, integral leg 118 of the support is butted against sub siding 66, and support 112 is fastened in place as by nails 122.

As is best shown in FIG. 1, window 28 is surrounded by a trim band 124. This trim band has upper and lower trim band segments 126 and 128 and vertical extending left- and right-hand trim band segments 132 and 134.

Upper trim band segment 126 is made up of a trim element 136 and a spacer 138 located midway between the opposite, upper and lower edge portions 140 and 142 of the trim element. Trim band segment 126 is fastened as by nails 143 to siding substrate 66. The lower portion 142 of trim band segment 126 is seated against the outwardly directed leg 116 of window support 112 and overlaps that leg.

Flashing 144 keeps moisture from penetrating into the gap 146 between trim element 136 and the substrate 66 of front building wall 26. Flashing 144 has a generally Z-shaped configuration and is made up of three integral legs 154, 156, and 158. Flashing leg 154 is vertically oriented and trapped between the substrate 66 of wall 26 and siding member 46*c*. Flashing leg 158 is also vertically oriented. This leg extends down over the upper edge or margin 140 of trim element 136. The third outwardly and downwardly inclined segment 156 of flashing 144 extends between the two vertically oriented segments 154 and 158.

The two vertically extending side segments 132 and 134 of trim band 124 are essentially duplicates; accordingly, only segment 134 will be described in detail herein. That segment, in a manner akin to upper trim band segment 126, is made up of a trim element 162 and a spacer 164. Trim band segment 134 is fastened as by nails 166 to the substrate 66 of vertical wall 26 with one edge 168 of the trim band element butting against the outwardly extending leg 116 of window pane support 112. The opposite edge 170 of trim band element 162 overlaps those siding elements embraced by the upper and lower margins 172 and 174 (see FIG. 1) of window 28. Those siding members butt spacer 164 with the siding member 46*d* shown in FIG. 6 being typical.

Lower trim band segment 128 is of the same construction as the other trim band segments 126, 132, and 134. The trim element 136 of that trim band segment is butted against the outwardly extending leg 116 of window pane support 112 in the same manner as the trim element 136 of trim band segment 126 except that, in the case of trim segment 128, it is the lower run of flange 116 which the trim band element is butted against. The opposite edge 176 of the lower segment 128 trim band element overlaps horizontally extending siding member 46*e* as shown in FIG. 1.

Figure 10:
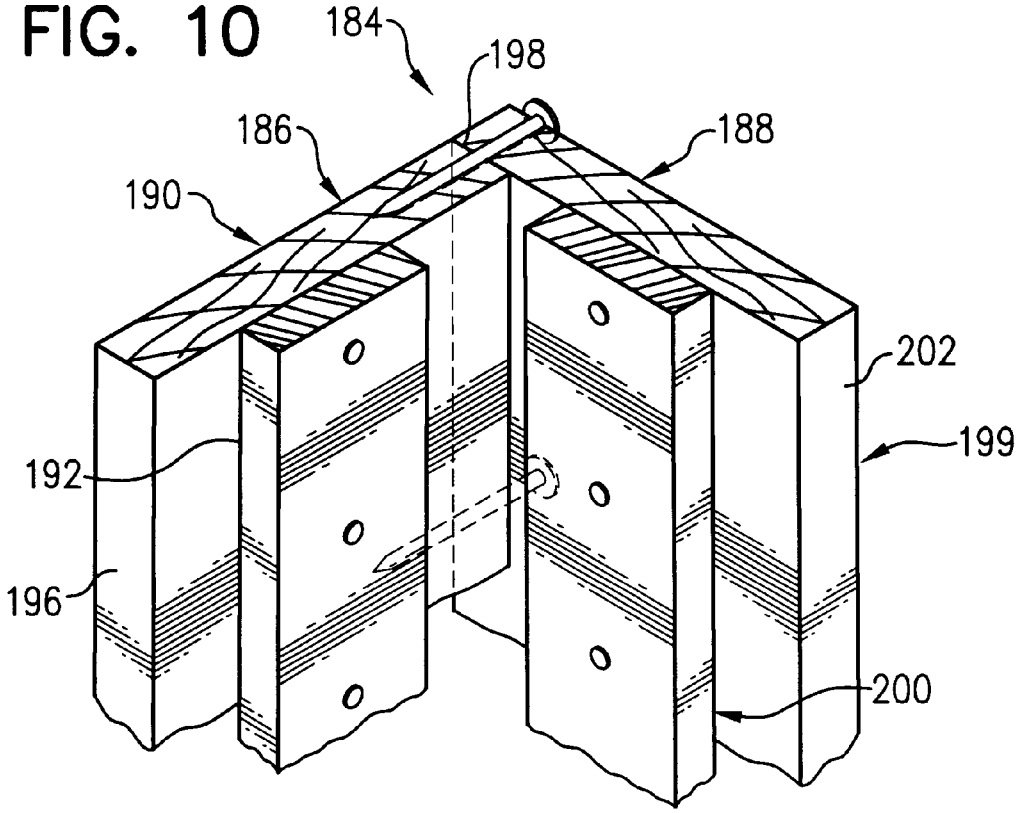
FIG. 10 is a perspective, sectional view of a corner treatment employing the principles of the present invention taken substantially along line 10—10 of FIG. 1.

Referring now to FIGS. 1 and 10, the principles of the present invention can also be utilized to advantage in trimming the corners of a building; for example, the corner where the side and front walls 24 and 26 of building 20 meet. As best shown in FIG. 10, the corner trim—identified by reference character 184—is made up of two trim segments 186 and 188.

Segment 186 consists of a trim element 190 and a spacer 192 fastened to trim element 190 midway its opposite edges 196 and 198.

Trim segment 188 is made up of a similarly related trim element 199 and spacer 200.

The segments 186 and 188 of corner trim 184 are fastened in place as by nails (not shown) with the edges 196 of trim band element 190 and 202 of trim band element 199 overlapping siding 46 of building side and front walls 24 and 26.

The invention may be embodied in many forms without departing from the spirit or essential characteristics of the invention. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

What is claimed is:

1. A building wall which comprises:

a substrate;

siding fastened to said substrate;

a horizontally oriented trim element juxtaposed to said siding;

flashing covering a gap between said substrate and an upper edge of said trim element, wherein the flashing extends across the upper edge of the trim element; and a spacer for spacing said trim element from said substrate.

2. A building wall as defined in claim 1 in which the spacer and trim elements are components of a trim band.

3. A building wall as defined in claim 2 in which the trim band has plural spacers.

4. A building wall as defined in claim 2 in which the trim band has a single spacer.

5. A building wall as defined in claim 2 in which said spacer and said trim element are integral parts of said trim band.

6. A building wall as defined in claim 5 in which the trim band is of monolithic construction.

7. A building wall as defined in claim 2 in which the trim band is fabricated from wood.

8. A building wall as defined in claim 2 in which the trim band is fabricated from a non-wooden material.

9. A building which has:

a vertically extending wall;

a window in said wall; and a trim band at a margin of said window;

said window comprising a pane of glass and a frame supporting said pane;

said trim band comprising a trim element and a spacer element; and said trim band being fastened to said wall with said spacer element against the wall and said trim element exposed; and flashing covering a gap between said wall and an upper edge of said trim element, wherein the flashing extends across the upper edge of the trim element.

10. A building as defined in claim 9 in which the trim band has plural spacer elements.

11. A building as defined in claim 9 in which the trim band has a single spacer element.

12. A building as defined in claim 9 in which said spacer element and said trim element are integral parts of said trim band.

13. A trim band as defined in claim 12 in which the trim band is of monolithic construction.

14. A building as defined in claim 9 in which the trim band is fabricated from wood.

15. A building as defined in claim 9 in which the trim band is fabricated from a non-wooden material.

16. A building as defined in claim 9 in which the wall is faced with siding and in which the siding butts the trim band.

17. A building as defined in claim 9 in which the trim band surrounds the window.

18. The combination of a trim band for an exterior building wall, and flashing, said trim band comprising the combination of:

a trim element which has an exposed side and a spacer element for spacing the trim element from a substrate to which the trim band is fastened, said spacer element being integrated with a side of the trim element opposite the exposed side; and the flashing covering a gap between the substrate and an upper edge of the trim element, wherein the flashing extends across the upper edge of the trim element.

19. The combination as defined in claim 18 in which the trim band has plural spacers.

20. The combination as defined in claim 18 in which the trim band has a single spacer.

21. The combination as defined in claim 20 which is fabricated from wood.

22. The combination as defined in claim 20 which is fabricated from a non-wooden material.

23. The combination as defined in claim 18 in which said spacer and said trim element are integral parts of said trim band.

24. The combination as defined in claim 23 which is of monolithic construction.

* * * * *